US007411380B2

(12) United States Patent
Chang et al.

(10) Patent No.: US 7,411,380 B2
(45) Date of Patent: Aug. 12, 2008

(54) NON-LINEARITY COMPENSATION CIRCUIT AND BANDGAP REFERENCE CIRCUIT USING THE SAME

(75) Inventors: Kuen-Shan Chang, Hsinchu (TW); Uei-Shan Uang, Shalu Township, Taichung County (TW)

(73) Assignee: Faraday Technology Corp., Hsin-Chu (TW)

( * ) Notice: Subject to any disclaimer, the term of this patent is extended or adjusted under 35 U.S.C. 154(b) by 241 days.

(21) Appl. No.: 11/490,608

(22) Filed: Jul. 21, 2006

(65) Prior Publication Data

US 2008/0018316 A1 Jan. 24, 2008

(51) Int. Cl.
*G05F 3/16* (2006.01)

(52) U.S. Cl. ..... 323/314; 323/315; 323/907

(58) Field of Classification Search ..... 323/313, 323/314, 315, 907

See application file for complete search history.

(56) References Cited

U.S. PATENT DOCUMENTS 4,808,908 A * 2/1989 Lewis et al. ..... 323/313
5,352,973 A * 10/1994 Audy ..... 323/313
6,052,020 A 4/2000 Doyle ..... 327/539
6,157,245 A * 12/2000 Rincon-Mora ..... 327/539
6,255,807 B1 * 7/2001 Doorenbos et al. ..... 323/314
6,566,849 B1 * 5/2003 Chavan et al. ..... 323/312
6,791,307 B2 * 9/2004 Harrison ..... 323/312
6,828,847 B1 * 12/2004 Marinca ..... 327/513
6,891,358 B2 * 5/2005 Marinca ..... 323/316
7,012,416 B2 * 3/2006 Marinca ..... 323/316
7,157,893 B2 * 1/2007 Lee ..... 323/314
7,173,407 B2 * 2/2007 Marinca ..... 323/316
7,193,454 B1 * 3/2007 Marinca ..... 327/539
7,253,597 B2 * 8/2007 Brokaw ..... 323/314
7,304,466 B1 * 12/2007 Kimura ..... 323/313
2007/0052473 A1 * 3/2007 McLeod ..... 327/539

* cited by examiner

*Primary Examiner*—Jeffrey L Sterrett
(74) *Attorney, Agent, or Firm*—Winston Hsu

(57) ABSTRACT

A non-linearity compensation circuit and a bandgap reference circuit using the same for compensating non-linear effects of a reference voltage are provided. In the non-linearity compensation circuit, the reference voltage is transformed into a temperature independent current. A current mirror mirrors the temperature independent current for biasing a bipolar junction transistor (BJT). Further, two resistors are used for estimating a non-linear voltage, so as to compensate the reference voltage.

27 Claims, 10 Drawing Sheets

NON-LINEARITY COMPENSATION CIRCUIT AND BANDGAP REFERENCE CIRCUIT USING THE SAME

BACKGROUND OF THE INVENTION

1. Field of Invention

The present invention relates to a non-linearity compensation circuit and a bandgap reference circuit using the same, and more particularly, to a non-linearity compensation circuit capable of improving the precision of a bandgap reference voltage and a bandgap reference circuit using the same.

2. Description of Related Art

Digital-to-analog converters (DACs), analog-to-digital converters (ADCs) or regulators need at least one fixed and stable reference voltage. It is preferred that the reference voltage is stably regenerated each time the power source is started. An ideal reference voltage even had better not be influenced by processing differences, changes in the operating temperature, and power source variations.

A bandgap reference circuit can be used to provide the reference voltage. Therefore, bandgap reference circuits play an important role in many electronic systems as they may determine the stability and precision of the entire systems.

FIG. 1 shows a circuit diagram of a conventional bandgap reference circuit. As shown in FIG. 1, the conventional bandgap reference circuit 100 comprises a current mirror composed of metal-oxide-semiconductor (MOS) transistors M101~M103, operation amplifiers OP101~OP103, resistors R101, R102, R103A and R103B, and two bipolar junction transistors (BJT) B101~B102. The connection of various elements can be understood from FIG. 1. The resistors R103A and R103B have the same resistance.

The reference voltage $V_{BG1}$ can be represented by the following equations.

$$V_{BG1}=0.5*(V_{NTC1}+V_{PTC1})=0.5*(V_{BE1A}+V_{PTC1})=0.5*(V_{BE1A}+K1*V_T) \quad (1)$$

$$V_{PTC1}=I_{PTAT1}*R102=(\Delta V_{BE}/R101)*R102 \quad (2)$$

$$\Delta V_{BE}=V_T*ln(n) \quad (3)$$

wherein, $V_T$ represents the thermal voltage (the value is KT/q, wherein K is the Boltzmann's constant=$1.28\times10^{-23}$ Joules/Kelvin, T is the absolute temperature, q=$1.602\times10^{-29}$ Coulomb), K1 is a constant, $V_{BE1A}$ represents the base-emitter voltage of the BJT transistor B101, $V_{NTC1}$ represents a negative temperature coefficient (NTC) voltage, $V_{PTC1}$ represents a proportional to absolute temperature (PTAT) voltage, $I_{PTAT1}$ is a PTAT current, and n is the size ratio of the transistor B102 to the transistor B101.

The base-emitter voltage $V_{BE}$ of the BJT transistors can be represented by the following equation.

$$V_{BE}=V_{G0}-(V_{G0}-V_{BE0})*T/T_0-(\eta-\alpha)*V_T ln(T/T_0) \quad (4)$$

In equation (4), $T_0$ represents the reference voltage, T represents the operating temperature, $V_{BE0}$ represents the base-emitter voltage obtained at the reference temperature $T_0$, $V_{G0}$ is the silicon bandgap voltage at the absolute temperature of 0, η is the structural coefficient of the BJT transistors (the value is between 2 and 6), and the coefficient α is determined by the type of the biasing current of the BJT transistors. When the biasing current is a PTAT current, α=1, and when the biasing current is a temperature independent current, α=0.

As the biasing current of the transistors B101 and B102 is equal to the PTAT current, α=1. Therefore, the base-emitter voltages $V_{BE1A}$ and $V_{BE1B}$ of the transistors B101 and B102 can be respectively represented by the following equations.

$$V_{BE1A}=V_{G0}-(V_{G0}-V_{BE0})*T/T_0-(\eta-1)*V_T ln(T/T_0) \quad (5)$$

$$V_{BE1B}=V_{G0}-(V_{G0}-V_{BE0})*T/T_0-(\eta-1)*V_T ln(T/T_0) \quad (6)$$

Introduce equations (2)~(6) into equation (1), the following equation is obtained.

$$V_{BG1}=\frac{1}{2}\times\left\{\left[V_{BG0}-(V_{BG0}-V_{BE0})\frac{T}{T_0}-(\eta-1)V_T\ln\frac{T}{T_0}\right]+\left[\frac{R102}{R101}\cdot V_T\cdot\ln(n)\right]\right\} \quad (7)$$

In equation (7), if K2=R102/R101*ln(n), K2*$V_T$ can be used to compensate the linear term in $V_{BE}$. (η−1)*$V_T$ln(T/T0) (or $V_T$ln(T/T0)) is a non-linear term in $V_{BE}$. Therefore, the compensation effect of the reference voltage $V_{BG1}$ is limited, and the non-linearity effect still exists.

FIG. 2 shows a concept diagram of compensation of the conventional bandgap reference circuit. FIG. 2 shows that the reference voltage $V_{BG}$ is the sum of K2*$V_T$ (proportional to absolute temperature) and $V_{BE}$ (negative temperature dependent). However, in the conventional bandgap reference circuit, $V_{BE}$ has a non-linearity effect. If the non-linearity effect of $V_{BE}$ is not well compensated, the characteristic diagram of the reference diagram presents a curve (non-ideal) phenomenon in the range of operating temperature, as shown in FIG. 3.

FIG. 3 shows that an ideal reference voltage $V_{BG}$ must remain stable in the range of operating temperatures, and be approximately 1.205V. The ideal $V_{BE}$ also must have a fine linear effect. However, the actual $V_{BE}$ has a non-linearity effect.

Therefore, the reference voltage resulting from adding the non-linear $V_{BE}$ and the linear K2*$V_T$ also presents the non-linear effect. Thus, the actual reference voltage exhibits quite a large difference in operating temperature range.

FIG. 4 shows a characteristic diagram of reference voltage $V_{GB}$-temperature of the conventional art under different power source VDD (10.V~1.5V) when the operating temperature is between −40° C. and 125° C., wherein curves A1~E1 represent the variation curves of $V_{GB}$ when VDD=1.5V, VDD=1.4V, VDD=1.3V, VDD=1.2V, and VDD=1.1V respectively.

It can be seen from FIG. 4 that the reference voltage obtained in the conventional art still varies much as the conventional art cannot compensate the non-linear term in the reference voltage.

Therefore, a bandgap reference circuit for obtaining a stable reference voltage that does not vary much by compensating the non-linear term is needed.

SUMMARY OF THE INVENTION

One objective of the present invention is to provide a non-linearity compensation circuit applicable in most bandgap reference circuits.

Another objective of the present invention is to provide a non-linearity compensation circuit and a bandgap reference circuit using the same, wherein the non-linearity compensation circuit can improve the precision of the reference voltage.

Still another objective of the present invention is to provide a non-linearity compensation circuit and a bandgap reference circuit using the same, wherein the circuit cost of the non-linearity compensation circuit is low, so it can be applied widely.

To achieve the aforementioned objectives, one embodiment of the present invention provides a bandgap reference circuit comprising a PTAT current mirror for generating a PTAT current and a non-linearity current, a first and a second BJT transistors biased by the PTAT current, an operation amplifier and voltage divider circuit for outputting a reference voltage in response to a base-emitter voltage of the first transistor, a PTAT voltage and a non-linear voltage, and a non-linearity compensation circuit for converting the reference voltage output from the operation amplifier and voltage divider circuit into a temperature independent current to compensate the non-linear effect and the temperature dependent effect of the reference voltage. The non-linearity compensation circuit includes a third BJT transistor biased by the temperature independent current, and a first resistor and a second resistor, wherein the voltage drops across the first resistor and the second resistor are the non-linear voltage.

The combination of another resistor and another BJT transistor can be used to obtain the function of the operation amplifier and voltage divider circuit, wherein the voltage drop of the resistor is the sum of the PTAT voltage and the non-linear voltage, and the base-emitter voltage of the BJT transistor is the negative temperature coefficient voltage.

In addition, another embodiment of the present invention provides a non-linearity compensation circuit for compensating the non-linear effect and the temperature dependent effect of a reference voltage generated by a bandgap reference circuit. The bandgap reference circuit includes a first transistor and a second transistor biased by a PTAT current, and a first resistor. The non-linearity compensation circuit includes an operation amplifier for receiving the reference voltage; a third transistor coupled to the operation amplifier, which together convert the reference voltage into a temperature independent current; a temperature independent current mirror for mirroring the temperature independent current; a fourth transistor for receiving the temperature independent current generated by the temperature independent current mirror and biased by the temperature independent current; and a second resistor and a third resistor, a non-linear voltage being across the second and third resistors.

In order to make the aforementioned and other features and advantages of the present invention comprehensible, preferred embodiments accompanied with figures are described in detail below.

DESCRIPTION OF EMBODIMENTS

Figure 5:
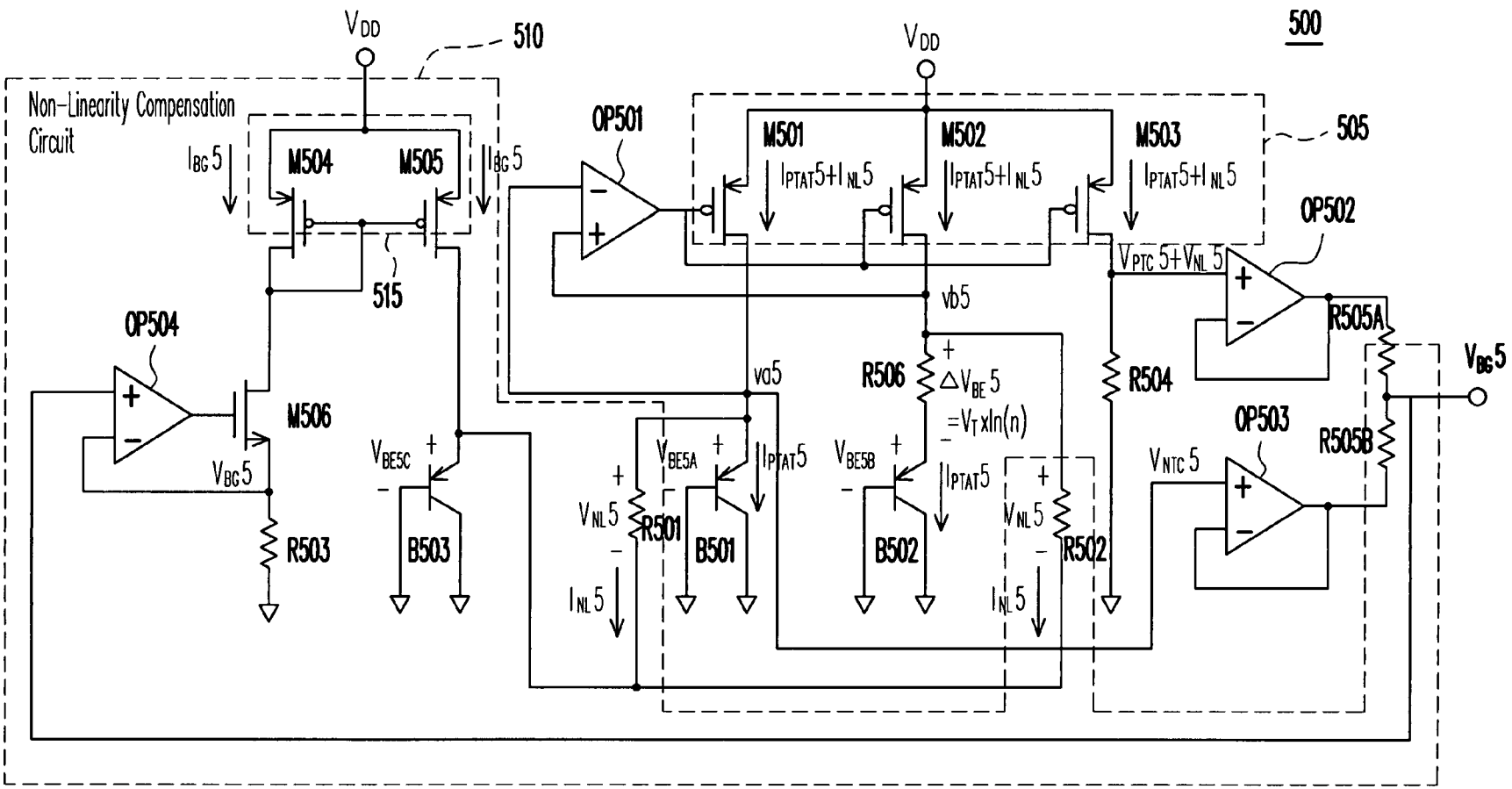
FIG. 5 is a circuit diagram of a bandgap reference circuit according to a first embodiment of the present invention.

FIG. 5 is a circuit diagram of a bandgap reference circuit according to a first embodiment of the present invention. The bandgap reference circuit 500 of this embodiment at least comprises a PTAT current mirror 505 formed by MOS transistors M501~M503, operation amplifiers OP501~503, BJT transistors B501 and B502, resistors R504, R505A, R505B and R506, and a non-linearity compensation circuit 510. The non-linearity compensation circuit 510 at least includes a temperature independent current mirror 515 formed by MOS transistors M504 and M505, an operation amplifier OP504, an MOS transistor M506, a BJT transistor B503, and resistors R501, R502, and R503.

The source of the MOS transistor M501 is connected to a power source VDD, the drain thereof is connected to the emitter of the BJT transistor B501 (i.e., node Va5), and the gate thereof is connected to the output of the operation amplifier OP501 and the gates of the MOS transistors M502 and M503. The source of the MOS transistor M502 is connected to the power source VDD, the drain thereof is connected to the emitter of the BJT transistor B502 (i.e., node Vb5), and the gate thereof is connected to the output of the operation amplifier OP501 and the gates of the MOS transistors M501 and M503. The source of the MOS transistor M503 is connected to the power source VDD, the drain thereof is connected to the positive input terminal of the operation amplifier OP502 and one terminal of the resistor R504, and the gate thereof is connected to the output of the operation amplifier OP501 and the gates of the MOS transistors M501 and M502. The output of the operation amplifier OP501 is coupled to the gates of the MOS transistors M501~M503. As the MOS transistors M501~M503 have the same size, they generate the same current.

The positive input terminal of the operation amplifier OP501 is connected to the node Vb5, the negative input terminal thereof is connected to the node Va5, and the output terminal thereof is connected to the gates of the MOS transistors M501~M503. The positive input terminal of the operation amplifier OP502 is connected to the drain of the MOS transistor M503 and the resistor R504, the negative input terminal thereof is coupled to the output terminal thereof, and the output terminal thereof is coupled to the reference voltage $V_{BG}$5 via the resistor R505A. The positive input terminal of the operation amplifier OP502 is connected to the node Va5, the negative input terminal thereof is coupled to the output terminal thereof, and the output terminal thereof is coupled to the reference voltage $V_{BG}$5 via the resistor R505B. Therefore, the voltage $V_{NTC}$5 is equal to the $V_{BE5A}$ of the transistor B501. As known from FIG. 5, the positive input voltage of the operation amplifier OP502 is $V_{PTC}$5+$V_{NL}$5, wherein $V_{PTC}$5 represents a voltage proportional to absolute temperature, and $V_{NL}$5 represents the non-linear dependent voltage.

The emitter of the BJT transistor B501 is connected to the node Va5, and the collector and the base thereof are both grounded. The emitter of the BJT transistor B502 is connected to the node Vb5 via the resistor R506, and the collector and the base thereof are both grounded.

The resistor R504 is coupled between the drain of the MOS transistor M503 and the ground terminal. The resistors R505A and R505B function as a voltage divider circuit to divide $V_{BG}$5 from the output voltages of the operation amplifiers OP502 and OP503. The resistors R505A and R505B have the same resistance. The resistor R506 is coupled between the node Vb5 and the emitter of the BJT transistor B502.

The source of the MOS transistor M504 is coupled to the power source VDD, the gate thereof is coupled to its drain and the gate of the MOS transistor M505, and the drain thereof is coupled to the drain of the MOS transistor M506. The source of the MOS transistor M505 is coupled to the power source VDD, the gate thereof is coupled to the gate and the drain of the MOS transistor M504, and the drain thereof is coupled to the emitter of the BJT transistor B503.

The source of the MOS transistor M506 is coupled to the negative input terminal of the operation amplifier OP504 and the resistor R503, the gate thereof is coupled to the output terminal of the operation amplifier OP504, and the drain thereof is coupled to the drain and the gate of the MOS transistor M504.

The positive input terminal of the operation amplifier OP504 is coupled to the reference voltage $V_{BG}$5, the negative input terminal thereof is coupled to the source of the MOS transistor M506 and the resistor R503, and the output terminal thereof is coupled to the gate of the MOS transistor M506.

The emitter of the BJT transistor B503 is coupled to the drain of the MOS transistor M505 and the resistors R501 and R502, and the base and the collector thereof are both grounded.

The resistor R501 is coupled between the emitter of the BJT transistor B501 and the emitter of the BJT transistor B503. A current $I_{NL}$5 flows through the resistor R501, and the voltage drop across the resistor is $V_{NL}$5. The resistor R502 is coupled between the node Vb5 and the emitter of the BJT transistor B503. The current $I_{NL}$5 also flows through the resistor R502, and the voltage drop across the resistor R502 is also $V_{NL}$5. The resistors R501 and R502 are coupled to each other and have the same resistance. The resistor R503 is coupled between the source of the MOS transistor M506 and the ground terminal.

The output voltage of the operation amplifier OP501 adjusts the MOS transistors M501 and M503, such that Va5=Vb5, which further causes a voltage drop $\Delta V_{BE}$5 across the resistor R506. The voltage drop $\Delta V_{BE}$5 across the resistor R506 is represented by the following equation:

$$\Delta V_{BE}5=V_T*ln(n) \tag{8}$$

wherein n is the size ratio of the BJT transistor B502 to the BJT transistor B501 (n:1).

To facilitate the explanation, the current generated by the MOS transistors M501~M503 is defined as $I_{PTAT}5+I_{NL}5$ hereinafter, wherein $I_{PTAT}$5 represents the current proportional to absolute temperature, and $I_{NL}$5 represents the non-linear dependent current.

As the output voltage of the MOS transistor M503 is $I_{PTAT}5+I_{NL}5$, a voltage drop across occurs on the resistor R504 is R504*($I_{PTAT}5+I_{NL}5$)=$V_{PTC}5+V_{NL}5$, wherein $V_{PTC}$5 represents the voltage proportional to absolute temperature, and $V_{NL}$5 represents the non-linear dependent voltage. Therefore, the positive input voltage of the operation amplifier OP502 is $V_{PTC}5+V_{NL}5$.

Moreover, as the positive input terminal voltage $V_{NTC}$5 of the operation amplifier OP503 is equal to $V_{BE5A}$, the following equation can be obtained through the operation of the operation amplifiers OP502 and OP503:

$$V_{BG}5=0.5*(V_{PTC}5+V_{NTC}+V_{NL}5) \tag{9}$$

As the transistors B501 and B502 are biased by the PTAT current, α=1. Therefore, $V_{BE5A}$ and $V_{BE5B}$ can be represented by the following equation:

$$V_{BE5A}=V_{BE5B}=V_{G0}-(V_{G0}-V_{BE0})*T/T_0-(\eta-1)*V_T ln(T/T_0) \tag{10}$$

$V_{BE5A}$ and $V_{BE5B}$ are negative temperature coefficient dependent voltages. The non-linear voltage $V_{NL}$5 still exists in equation 9, so a non-linearity compensation circuit 510 is used to estimate and compensate the non-linear $V_{NL}$5 in this embodiment.

As shown in FIG. 5, the reference voltage $V_{BG}$5 is fed back to the positive input terminal of the operation amplifier OP504 in the non-linearity compensation circuit 510. The operation amplifier OP504 and the MOS transistor M506 can be considered as a voltage-to-current converting unit for converting the reference voltage $V_{BG}$5 into a current $I_{BG}$5. The current $I_{BG}$5 may be regarded as a temperature independent current. The current mirror 515, which is a temperature independent current generator, mirrors the temperature independent current $I_{BG}$5 to the MOS transistor M505 and the BJT transistor B503. As the biasing current of the BJT transistor B503 is a temperature independent current, a can be considered as 0. Therefore, $$V_{BE5C}=V_{G0}-(V_{G0}-V_{BE0})*T/T_0-(\eta)*V_T ln(T/T_0) \tag{11}$$

Subtract equation (11) from equation (10), and the following equation can be obtained:

$$V_{BE5A}-V_{BE5C}=V_T\ln\frac{T}{T_0} \tag{12}$$

As known from equation (7), the non-linear term of the reference voltage is $V_T\ln(T/T_0)=V_{NL}5$. To estimate the value of the non-linear voltage, in this embodiment, let the resistor R501 across between the emitter of the BJT transistor B501 and the emitter of the BJT transistor B503. Therefore, the voltage drop across the resistor R501 (and the resistor R502) is the non-linear voltage $V_{NL}$5.

Therefore, the following equation is obtained by rearranging the equations described above, $$\begin{aligned} V_{BG5} &= \frac{1}{2}(V_{NTC5}+V_{PTC5}+V_{NL5}) \\ &= \frac{1}{2}\times\left[V_{BE5A}+R504\cdot\left(\frac{\Delta V_{BE5}}{R506}+\frac{V_{NL}}{R502}\right)\right] \\ &= \frac{1}{2}\times\left\{\left[V_{BG5}-(V_{BG5}-V_{BE0})\frac{T}{T_0}-(\eta-1)V_T\ln\frac{T}{T_0}\right]+\right. \\ &\quad \left.\left[\frac{R504}{R506}\cdot V_T\cdot\ln(n)\right]+\left[\frac{R504}{R502}V_T\ln\frac{T}{T_0}\right]\right\} \end{aligned} \tag{13}$$

The definition of η and $V_{BE}$0 are as described above. By selecting appropriate resistance of R504 and R502, the (η−1) is made to be equal to or very close to the ratio of (R504/R502), thus the equation (13) can be simplified into the following equation.

$$V_{BG5} = \frac{1}{2} \times \left\{ \left[ V_{BG5} - (V_{BG5} - V_{BE0}) \frac{T}{T_0} \right] + \left[ \frac{R504}{R506} \cdot V_T \cdot \ln(n) \right] \right\} \quad (14)$$

As known from equation 14, after being compensated by the non-linearity compensation circuit 510, the non-linear effect of the reference voltage $V_{BG}$5 is well compensated, and can be considered as almost temperature independent.

The non-linearity compensation circuit 510 generates the temperature independent current $I_{BG}$5 by using the fed back reference voltage $V_{BG}$5 that can be considered as temperature independent. In addition, the two resistors R501 and R502 in the non-linearity compensation circuit 510 are across the transistors B501/B502 ($\alpha$=1, biased by the current proportional to absolute temperature) and the temperature independent transistor B503($\alpha$=0, biased by the temperature independent current), so as to estimate the non-linear voltage $V_{NL}$5.

Figure 1:
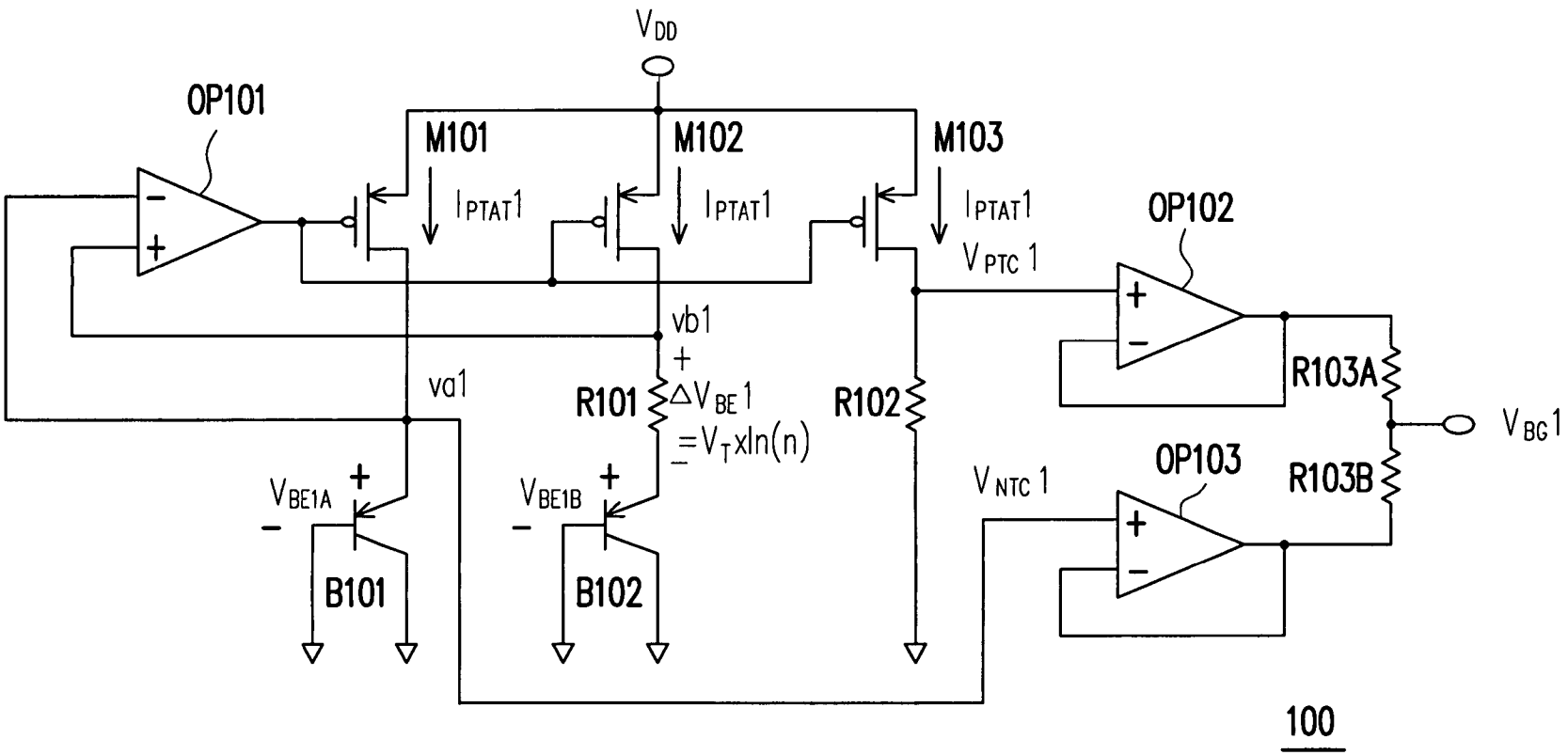
FIG. 1 (PRIOR ART)
FIG. 1 is a circuit diagram of a conventional bandgap reference circuit.
Figure 2:
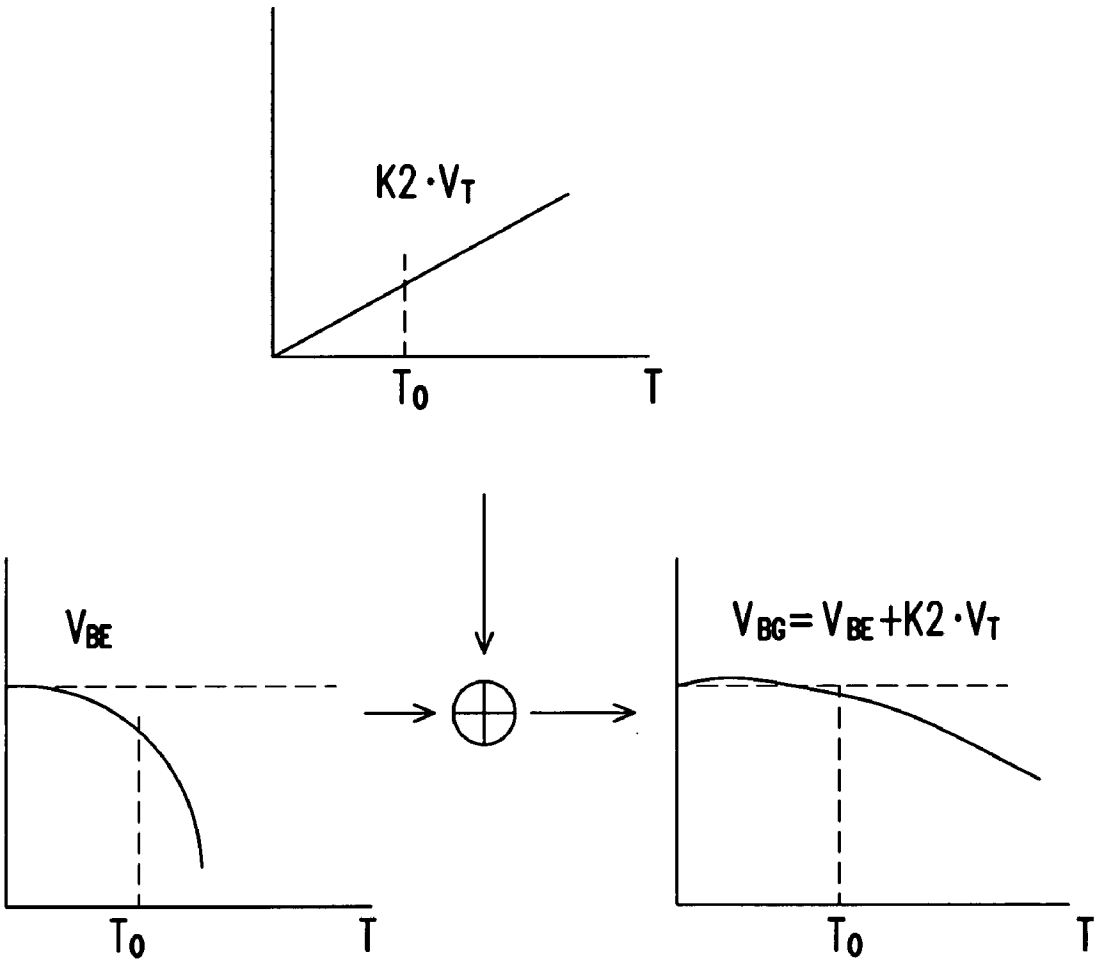
FIG. 2 is a concept diagram of compensation of the conventional bandgap reference circuit.
Figure 3:
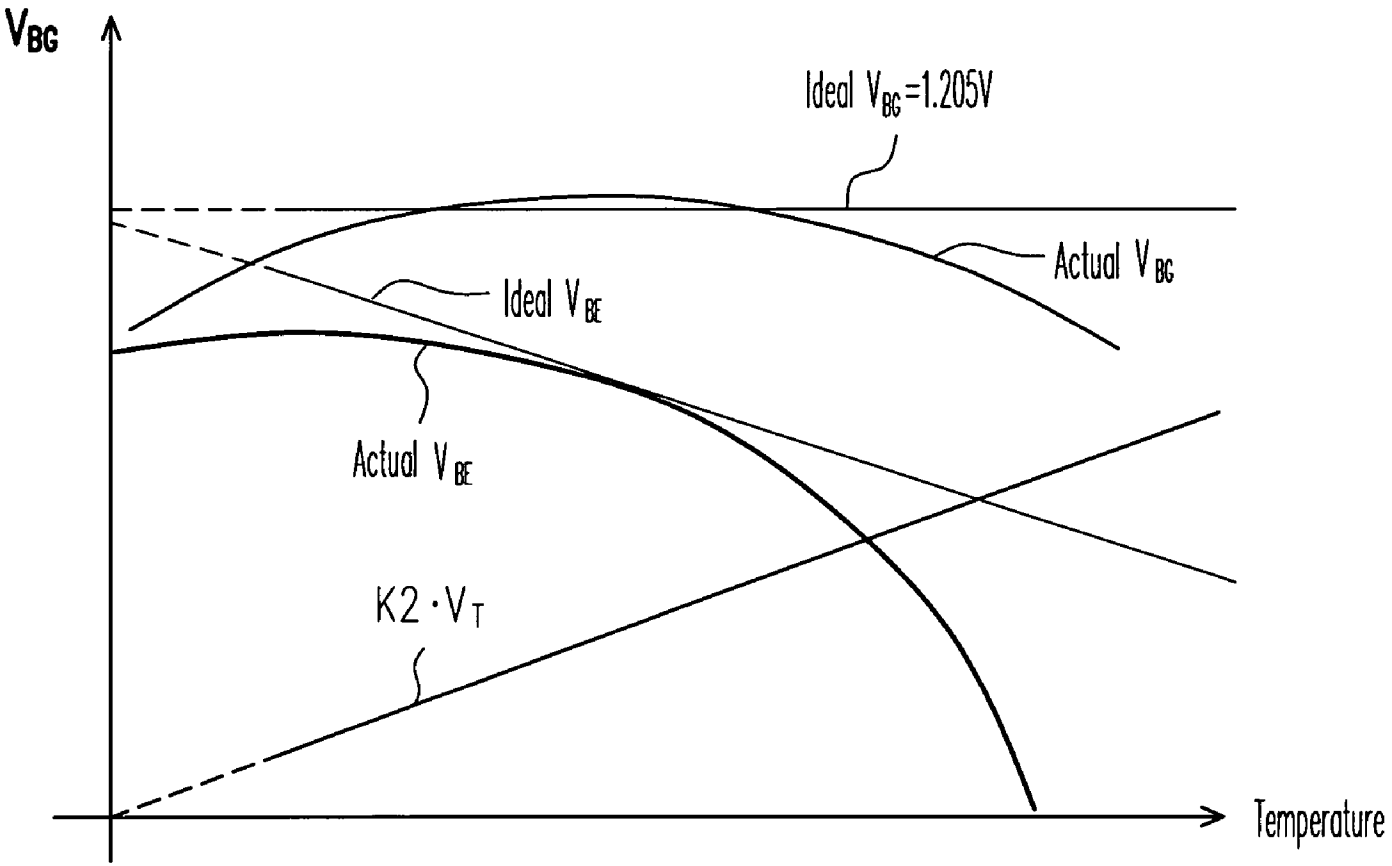
FIG. 3 is the reference voltage-temperature characteristic diagram of the conventional bandgap reference circuit.
Figure 4:
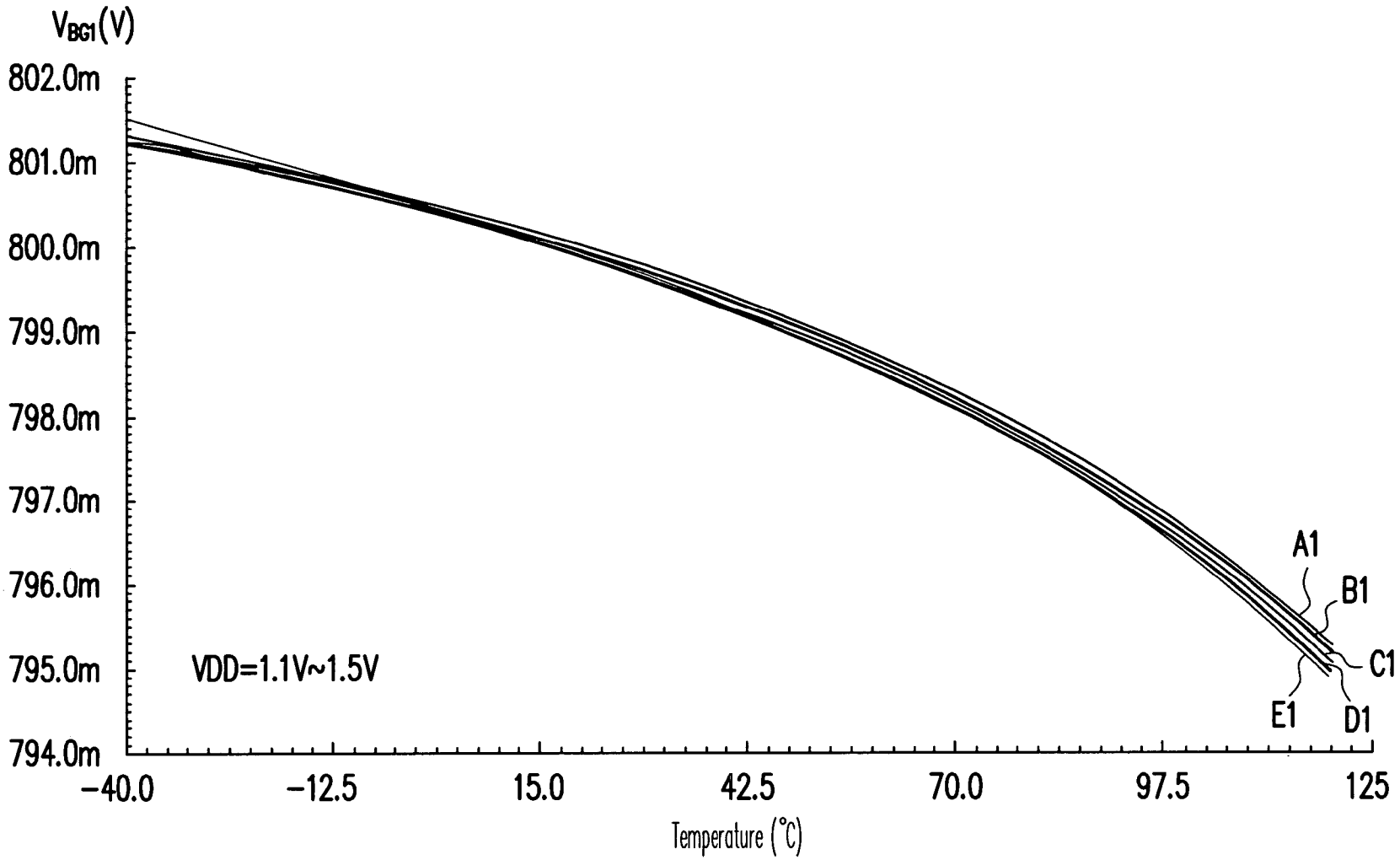
FIG. 4 is the reference voltage-temperature characteristic diagram of the conventional bandgap reference circuit under different voltage sources.
Figure 6:
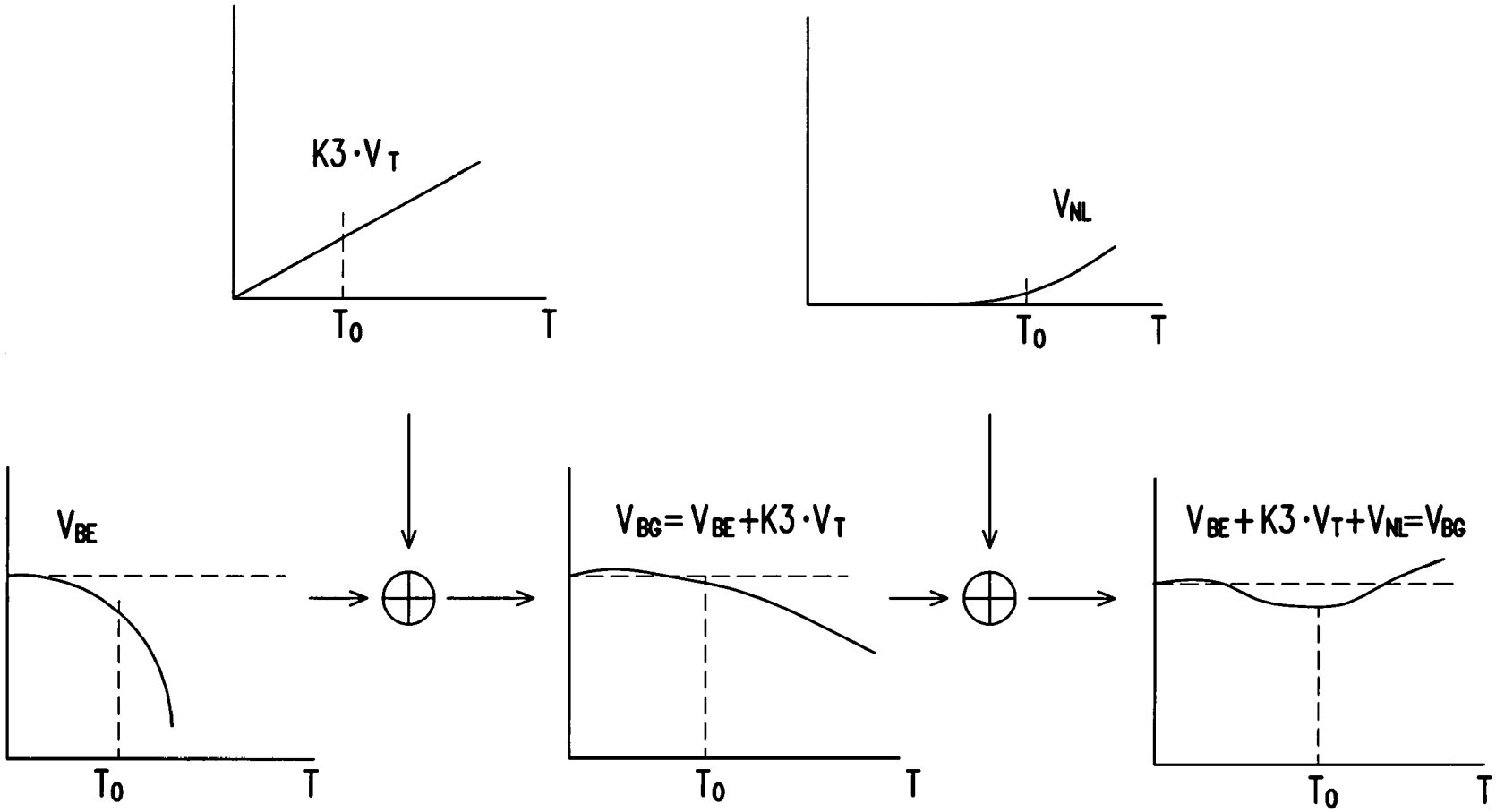
FIG. 6 is the concept diagram of compensation of the bandgap reference circuit according to the first embodiment of the present invention.

FIG. 6 is the concept diagram of the compensation of the bandgap reference circuit according to the first embodiment of the present invention. As shown in FIG. 6, the generated reference voltage $V_{BG}$ of the first embodiment is the sum of K3*$V_T$ (proportional to absolute temperature), $V_{BE}$ (the negative temperature coefficient), and $V_{NL}$ (the non-linear compensation term), wherein K3 is a constant equal to R504/R506*ln(n). As known from FIG. 6, the non-linear effect originally included in the $V_{BE}$ is well compensated by $V_{NL}$ in the first embodiment. Therefore, in the range of operating temperature, the curve (non-ideal) phenomenon in the characteristic diagram of the reference voltage is alleviated in comparison to FIG. 2.

Figure 7A:
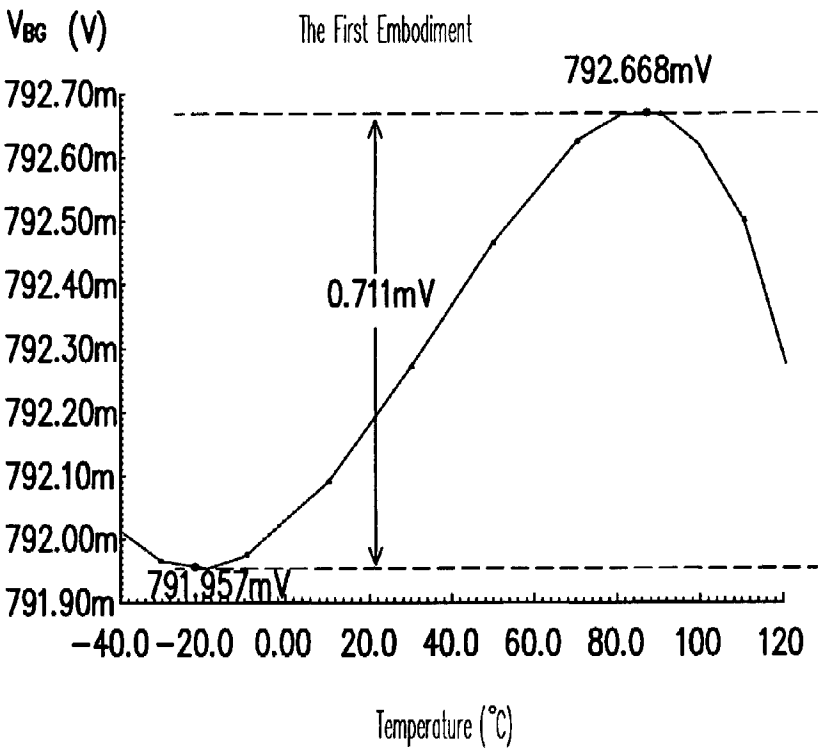
FIGS. 7A and 7B are reference voltage-temperature characteristic diagrams of the first embodiment and the conventional art under the same voltage source respectively.
Figure 7B:
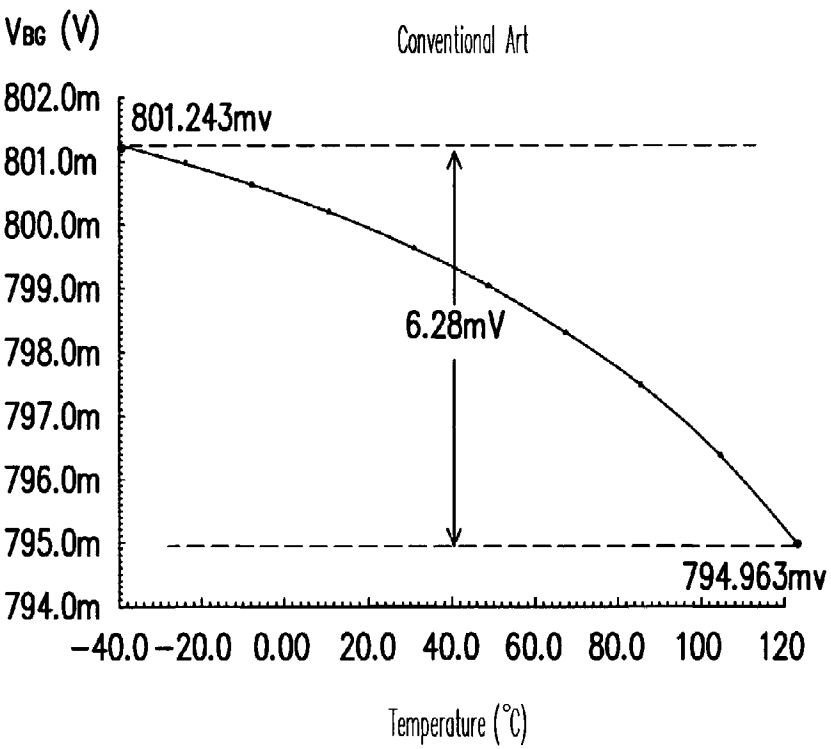

FIGS. 7A and 7B are reference voltage-temperature characteristic diagrams of the first embodiment and the conventional art under the same voltage source (VDD=1.2 V) respectively. Under this condition, the variation range of the reference voltage according to the conventional art is 6.28 mV, and under this condition, the variation range of the reference voltage according to the first embodiment is only 0.711 mV. It is apparent that the variation range of the reference voltage according to the first embodiment is greatly reduced.

Figure 8:
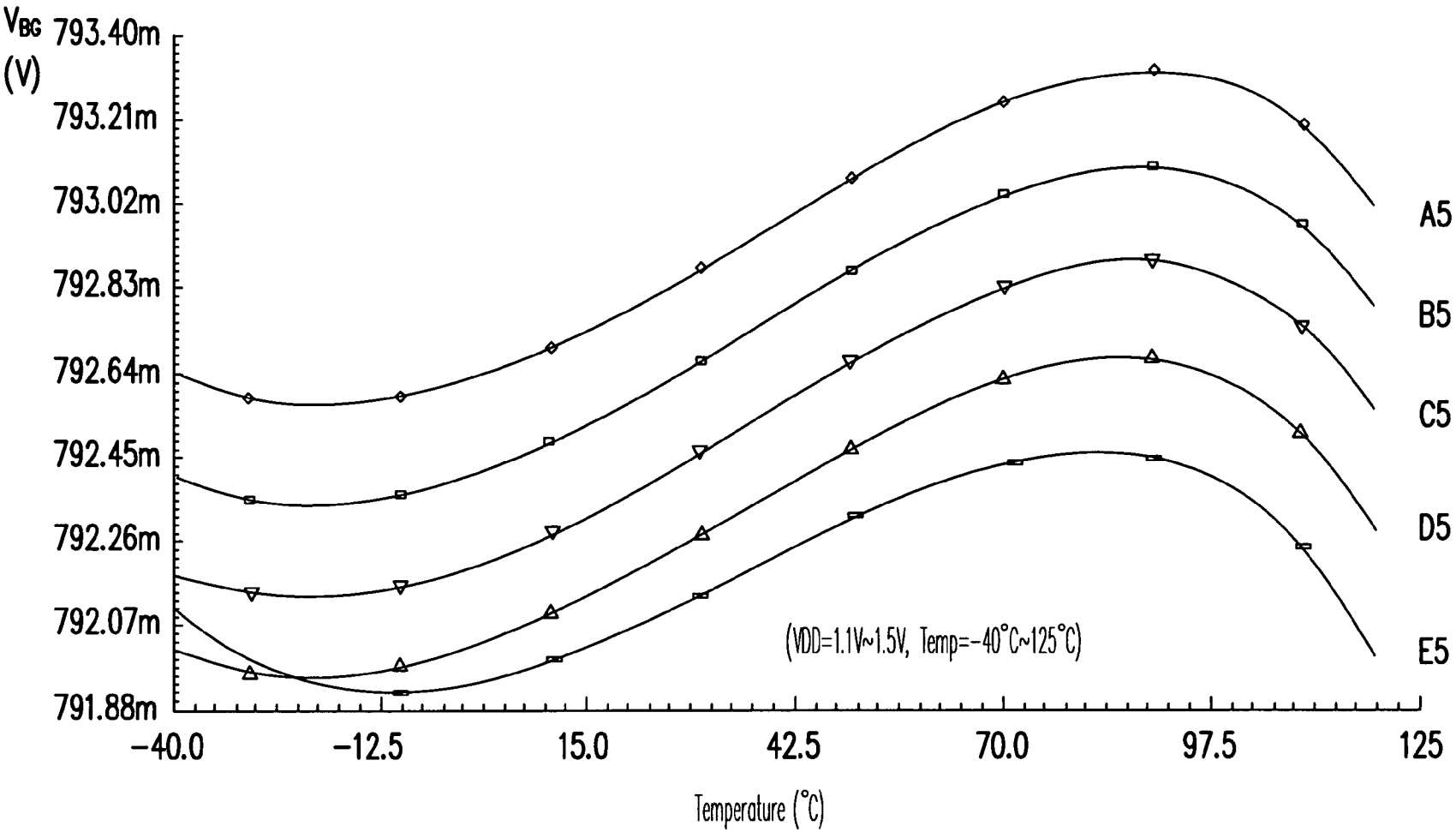
FIG. 8 is a reference voltage-temperature characteristic diagram of the bandgap reference circuit according to the first embodiment of the present invention under different voltage sources.

FIG. 8 is a characteristic diagram of the measured reference voltage $V_{GB}$-temperature according to the first embodiment under different power source VDD (1.0V~1.5V) when the operating temperature is between −40° C. and 125° C., wherein curves A5~E5 represent the variation curves of $V_{GB}$ when VDD=1.5V, VDD=1.4V, VDD=1.3V, VDD=1.2V, and VDD=1.1V respectively.

Figure 9:
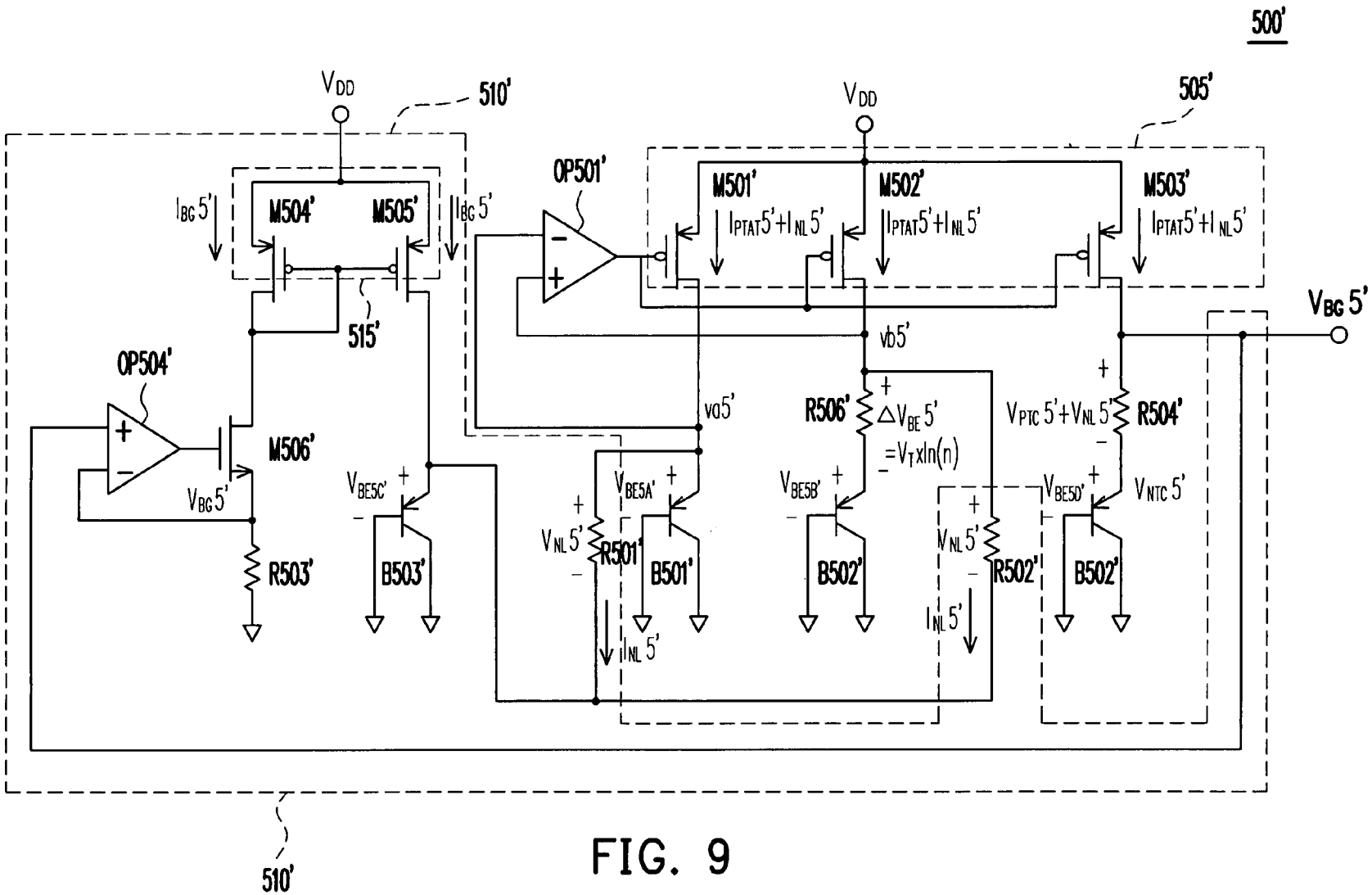
FIG. 9 is a circuit diagram of a bandgap reference circuit according to a second embodiment of the present invention.

FIG. 9 is a circuit diagram of a bandgap reference circuit 500' according to a second embodiment of the present invention. The architecture of the bandgap reference circuits 500' is similar to that of the bandgap reference circuit 500 shown in FIG. 5, so the same or like reference symbols represent the same or like elements, only except that the operation amplifiers OP502, OP503 and the resistor R504 in FIG. 5 are replaced by the BJT transistor B504' and the resistor R504' in FIG. 9.

With the concept of FIG. 5, it can be known that the reference voltage $V_{BG}$5' generated by the architecture of FIG. 9 can be represented by the following equation:

$$V_{BG5'} = V'_{NTC} + V'_{PTC} + VNL' \quad (15)$$

-continued $$= \left[ V_{BE5D} + R504' \cdot \left( \frac{\Delta V_{BE5'}}{R506'} + \frac{V_{NL5'}}{R502'} \right) \right]$$

$$= \left\{ \left[ V_{BG}5' - (V_{BG}5' - V_{BE0}) \frac{T}{T_0} - (\eta - 1) V_T \ln \frac{T}{T_0} \right] + \left[ \frac{R504'}{R506'} \cdot V_T \cdot \ln(n) \right] + \left[ \frac{R504'}{R502'} V_T \ln \frac{T}{T_0} \right] \right\}$$

In FIG. 9, the elements the same as or similar to the elements in FIG. 5 are represented with similar symbols. As the operation of the bandgap reference circuit 500' of FIG. 9 can be deduced from the above description for the bandgap reference circuit 500, it will not be described here again.

Figure 10B:
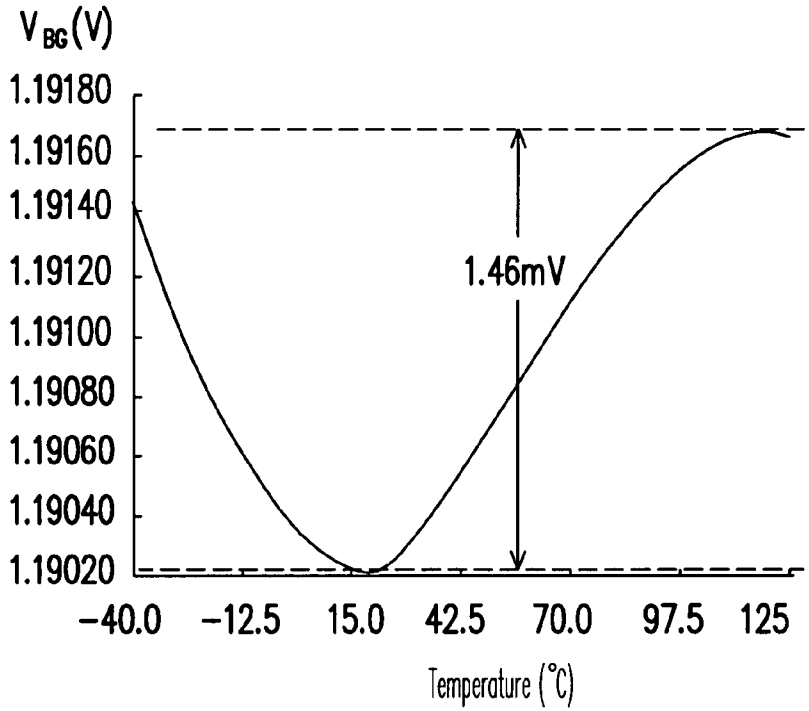
FIGS. 10A and 10B are the reference voltage-temperature characteristic diagrams of the bandgap reference circuit according to the second embodiment of the present invention.
Figure 10A:
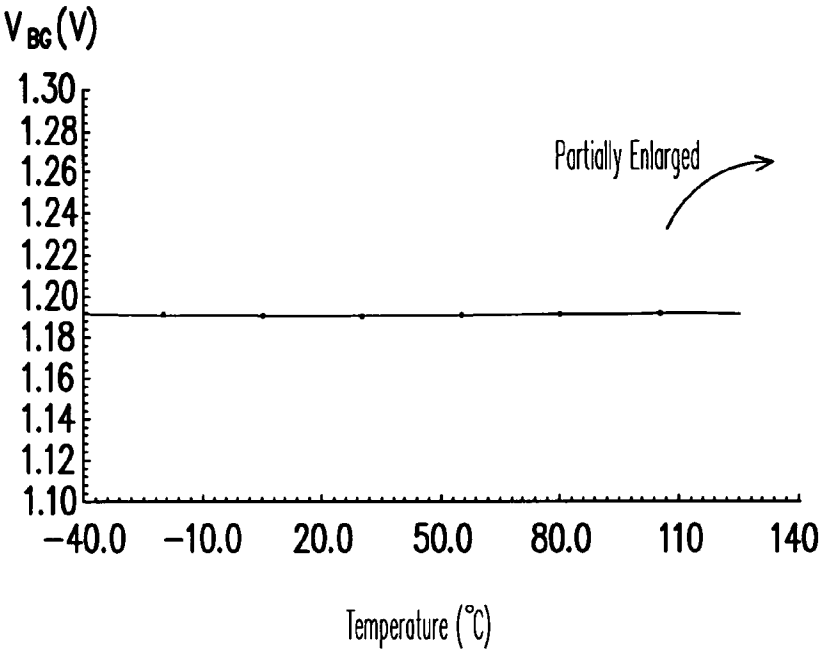

FIGS. 10A and 10B are the reference voltage-temperature characteristic diagrams of the bandgap reference circuit according to the second embodiment. FIG. 10B is an enlarged partial view of FIG. 10A. It can be known from FIG. 10B that the variation range of the reference voltage is reduced to only 1.46 mV in the second embodiment.

As known from the architectures shown in FIGS. 5 and 9, the non-linearity compensation circuit according to the present invention is applicable in most bandgap reference circuits.

To sum up, the non-linearity compensation circuit according to the present invention can improve the precision of the reference voltage. In addition, the circuit cost of the non-linearity compensation circuit is not high, thus it can be widely applied.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A bandgap reference circuit, comprising:

a PTAT current unit, generating a PTAT current and summing a non-linear current;

a first transistor, biased by the PTAT current output from the PTAT current unit;

a second transistor, biased by the PTAT current output from the PTAT current unit;

an amplifier and voltage divider circuit, for outputting a reference voltage in response to a base-emitter voltage, a PTAT voltage, and a non-linear voltage; and a non-linearity compensation circuit, for converting the reference voltage as a temperature independent bias current, wherein the non-linearity compensation circuit comprises:

a third transistor, biased by the temperature independent current;

a first resistor, coupled to the first transistor and the third transistor, wherein the voltage drop across the first resistor is the non-linear voltage; and a second resistor, coupled to the third transistor, wherein the voltage drop across the second resistor is the non-linear voltage;

wherein the non-linear effect and the temperature dependent effect of the reference voltage are compensated by the non-linearity compensation circuit.

2. The bandgap reference circuit as claimed in claim 1, further comprising:

a third resistor, coupled between the PTAT current mirror and the second transistor, the voltage drop across the third resistor being $V_T \ln(n)$.

3. The bandgap reference circuit as claimed in claim 2, further comprising:

a fourth resistor, coupled between the PTAT current mirror and a ground terminal, wherein the PTAT current and the non-linear current output from the PTAT current mirror flow through the fourth resistor, such that the voltage drop across the fourth resistor is a sum of the PTAT voltage and the non-linear voltage.

4. The bandgap reference circuit as claimed in claim 3, wherein the PTAT current mirror comprises:

a fourth transistor, having a source coupled to a power source, a gate, and a drain coupled to the first transistor;

a fifth transistor, having a source coupled to the power source, a gate, and a drain coupled to the third resistor; and a sixth transistor, having a source coupled to the power source, a gate, and a drain coupled to the fourth resistor;

wherein the fourth, the fifth and the sixth transistors output the PTAT current and the non-linear current.

5. The bandgap reference circuit as claimed in claim 4, further comprising:

a first operation amplifier, having a positive input terminal coupled to the third resistor, a negative input terminal coupled to the first transistor, and an output terminal coupled to the gates of the fourth, the fifth, and the sixth transistors;

wherein the first operation amplifier adjusts the PTAT current mirror according to the voltage difference between a voltage at the positive input terminal of the first operation amplifier and a voltage at the negative input terminal of the first operation amplifier.

6. The bandgap reference circuit as claimed in claim 4, wherein the amplifier and voltage divider circuit comprises:

a second operation amplifier, having a negative input terminal, a positive input terminal coupled to the drain of the sixth transistor and the fourth resistor, and an output terminal being fed back to the negative input terminal;

a fifth resistor, coupled between the output terminal of the second operation amplifier and the reference voltage;

a third operation amplifier, having a negative input terminal, a positive input terminal coupled to the first transistor, and an output terminal being fed back to the negative input terminal; and a sixth resistor, coupled between the output terminal of the second operation amplifier and the reference voltage;

wherein the fifth resistor and the sixth resistor divide the voltages at the output terminals of the second and the third operation amplifiers for generating the reference voltage.

7. The bandgap reference circuit as claimed in claim 4, wherein the non-linearity circuit comprises:

a fourth operation amplifier, having a positive input terminal coupled to the reference voltage, a negative input terminal, and an output terminal;

a seventh transistor, having a source coupled to the negative input terminal of the fourth operation amplifier, a gate coupled to the output terminal of the fourth operation amplifier, and a drain;

a seventh resistor, coupled between the source of the seventh transistor and the ground terminal; and a temperature independent current mirror, coupled to the third transistor and the seventh transistor;

wherein the fourth operation amplifier and the seventh transistor convert the reference voltage as the temperature independent bias current, and the temperature independent current mirror mirrors the temperature independent current to the third transistor.

8. The bandgap reference circuit as claimed in claim 7, wherein the temperature independent current mirror comprises:

an eighth transistor, having a source coupled to the power source, a gate, and a drain coupled to the drain of the seventh transistor, wherein the gate and the drain of the eighth transistor are coupled to each other; and a ninth transistor, having a source coupled to the power source, a gate coupled to the gate and the drain of the eighth transistor, and a drain coupled to the third transistor.

9. The bandgap reference circuit as claimed in claim 8, wherein the first transistor has:

an emitter coupled to the negative input terminal of the first operation amplifier, the positive input terminal of the third amplifier, the drain of the fourth transistor and the first resistor;

a base grounded; and a collector grounded.

10. The bandgap reference circuit as claimed in claim 9, wherein the second transistor has an emitter coupled to the second resistor, and a base and a collector both grounded.

11. The bandgap reference circuit as claimed in claim 10, wherein the third transistor has an emitter coupled to the drain of the ninth transistor, the first resistor and the second resistor; and a base and a collector both grounded, wherein the first resistor is coupled between the emitter of the first transistor and the emitter of the third transistor, and the second resistor is coupled between the third resistor and the emitter of the third transistor.

12. A bandgap reference circuit, comprising:

a PTAT current unit, generating a PTAT current and summing a non-linear current;

a first transistor, biased by the PTAT current output from the PTAT current unit;

a second transistor, biased by the PTAT current output from the PTAT current unit;

a first resistor, coupled to the PTAT current mirror, wherein the PTAT current and the non-linear current output from the PTAT current mirror flow through the first resistor, such that the voltage drop across the first resistor is a PTAT voltage and a non-linear voltage;

a third transistor, coupled to the first resistor, wherein a base-emitter voltage of the third transistor is a negative temperature coefficient voltage, and a reference voltage is output from a node between the first resistor and the PTAT current mirror; and a non-linearity compensation circuit, converting the reference voltage into a temperature independent current, wherein the non-linearity compensation circuit comprises:

a fourth transistor, biased by the temperature independent current;

a second resistor, coupled to the first transistor and the fourth transistor, wherein the voltage drop across the second resistor is the non-linear voltage; and a third resistor, coupled to the fourth transistor, wherein the voltage drop across the third resistor is the non-linear voltage;

wherein the non-linear effect and the temperature dependent effect of the reference voltage are compensated by the non-linearity compensation circuit.

13. The bandgap reference circuit as claimed in claim 12, further comprising:

a fourth resistor, coupled between the PTAT current mirror and the second transistor, the voltage drop across the fourth resistor being $V_T \ln(n)$, wherein $V_T$ is the threshold voltage of the second transistor, and n is the size ratio of the second transistor to the first transistor.

14. The bandgap reference circuit as claimed in claim 13, wherein the PTAT current mirror comprises:

a fifth transistor, having a source coupled to a power source, a gate, and a drain coupled to the first transistor;

a sixth transistor, having a source coupled to the power source, a gate, and a drain coupled to the fourth resistor; and a seventh transistor, having a source coupled to the power source, a gate, and a drain coupled to the first resistor;

wherein the fifth, the sixth and the seventh transistors output the PTAT current and the non-linear current.

15. The bandgap reference circuit as claimed in claim 14, further comprising:

a first operation amplifier, having a positive input terminal coupled to the fourth resistor, a negative input terminal coupled to the first transistor, and an output terminal coupled to the gates of the fifth, the sixth, and the seventh transistors;

wherein the first operation amplifier amplifies a voltage difference between a voltage at the positive input terminal of the first operation amplifier and a voltage at the negative input terminal of the first operation amplifier for driving the PTAT current mirror.

16. The bandgap reference circuit as claimed in claim 15, wherein the non-linearity circuit comprises:

a second operation amplifier, having a positive input terminal coupled to the reference voltage, a negative input terminal, and an output terminal;

an eighth transistor, having a source coupled to the negative input terminal of the second operation amplifier, a gate coupled to the output terminal of the second operation amplifier, and a drain;

a fifth resistor, coupled between the source of the eighth transistor and the ground terminal; and a temperature independent current mirror, coupled to the fourth transistor and the eighth transistor;

wherein the second operation amplifier and the eighth transistor convert the reference voltage into the temperature independent current, and the temperature independent current mirror mirrors the temperature independent current to the fourth transistor.

17. The bandgap reference circuit as claimed in claim 16, wherein the temperature independent current mirror comprises:

a ninth transistor, having a source coupled to the power source, a gate, and a drain coupled to the drain of the eighth transistor, wherein the gate and the drain of the ninth transistor are coupled to each other; and a tenth transistor, having a source coupled to the power source, a gate coupled to the gate and the drain of the ninth transistor, and a drain coupled to the fourth transistor.

18. The bandgap reference circuit as claimed in claim 17, wherein the first transistor has:

an emitter coupled to the negative input terminal of the first operation amplifier, the drain of the fifth transistor and the second resistor;

a base grounded; and a collector grounded.

19. The bandgap reference circuit as claimed in claim 18, wherein the second transistor has an emitter coupled to the fourth resistor, and a base and a collector both grounded.

20. The bandgap reference circuit as claimed in claim 19, wherein the third transistor has an emitter coupled to the first resistor, and a base and a collector both grounded.

21. The bandgap reference circuit as claimed in claim 20, wherein the fourth transistor has an emitter coupled to the drain of the tenth resistor, the first resistor and the second resistor; and a base and a collector both grounded;

wherein the second resistor is coupled between the emitter of the first transistor and the emitter of the fourth transistor, and the third resistor is coupled between the fourth resistor and the emitter of the fourth transistor.

22. A non-linearity compensation circuit, for compensating the non-linear effect and the temperature dependent effect of a reference voltage generated by a bandgap reference circuit, the bandgap reference circuit having a first transistor and a second transistor both biased by a PTAT current, and a first resistor, comprising:

an operation amplifier, for receiving the reference voltage;

a third transistor, coupled to the operation amplifier, wherein the operation amplifier and the third transistor convert the reference voltage into a temperature independent current;

a temperature independent current mirror, coupled to the third transistor, for mirroring the temperature independent current;

a fourth transistor, for receiving the temperature independent current generated by the temperature independent current mirror, biased by the temperature independent current;

a second resistor, coupled to the first transistor and the fourth transistor, a non-linear voltage being across the second resistor; and a third resistor, coupled to the first resistor and the fourth transistor, the non-linear voltage being across the third resistor.

23. The non-linearity compensation circuit as claimed in claim 22, wherein the operation amplifier has a positive input terminal for receiving the reference voltage, a negative input terminal, and an output terminal.

24. The non-linearity compensation circuit as claimed in claim 23, wherein the third transistor has a source coupled to the negative input terminal of the operation amplifier, a gate coupled to the output terminal of the operation amplifier, and a drain.

25. The non-linearity compensation circuit as claimed in claim 24, wherein:

the first transistor has an emitter coupled to the second resistor, and a base and a collector both grounded; and the second transistor has an emitter coupled to the first resistor, and a base and a collector both grounded.

26. The non-linearity compensation circuit as claimed in claim 25, wherein the fourth transistor has an emitter coupled to the temperature independent current mirror, the second resistor and the third resistor; and a base and a collector both grounded.

27. The non-linearity compensation circuit as claimed in claim 26, wherein the temperature independent current mirror comprises:

a fifth transistor, having a source coupled to the power source, a gate, and a drain coupled to the drain of the third transistor, wherein the gate and the drain of the fifth transistor are coupled to each other; and a sixth transistor, having a source coupled to the power source, a gate coupled to the gate and the drain of the fifth transistor, and a drain coupled to the fourth transistor.

* * * * *